US009032895B2

(12) United States Patent
Buck

(10) Patent No.: US 9,032,895 B2
(45) Date of Patent: May 19, 2015

(54) PROTECTIVE BOAT SWIM-STEP EXTENSION PLATFORM

(76) Inventor: Larry Ray Buck, Fort Worth, TX (US)

( * ) Notice: Subject to any disclaimer, the term of this patent is extended or adjusted under 35 U.S.C. 154(b) by 57 days.

(21) Appl. No.: 13/603,056

(22) Filed: Sep. 4, 2012

(65) Prior Publication Data

US 2014/0060414 A1 Mar. 6, 2014

(51) Int. Cl.
*B63B 23/02* (2006.01)
*B63B 27/14* (2006.01)
*B63B 27/36* (2006.01)

(52) U.S. Cl.
CPC ..... *B63B 27/143* (2013.01); *B63B 27/36* (2013.01)

(58) Field of Classification Search
CPC ..... B63B 27/143
USPC ..... 114/362.368, 369, 258, 259
See application file for complete search history.

(56) References Cited

U.S. PATENT DOCUMENTS 3,613,137 A * 10/1971 Eccles ..... 114/362
4,627,373 A * 12/1986 Nishida ..... 114/182
4,742,795 A * 5/1988 DePrey et al. ..... 114/362
6,298,801 B1 10/2001 May
6,327,992 B1 12/2001 Martin
6,474,256 B1 * 11/2002 Vogel ..... 114/368
6,782,842 B1 8/2004 Alvord
6,786,170 B2 9/2004 Trowbridge
7,237,503 B2 7/2007 Stepp
7,341,016 B2 3/2008 Terleski et al.
7,707,955 B1 5/2010 Johns, Jr. et al.

OTHER PUBLICATIONS

"Teak Swim Step Extension", Grand Banks Discussion Forum, Page last modified on Apr. 24, 2012, URL gbbeacon.com/phpBB2/viewtopic.php?t=5169&highlight=teak+swim+step+extension.

* cited by examiner

*Primary Examiner* — Edwin Swinehart
(74) *Attorney, Agent, or Firm* — David W. Carstens; Stephen Y. Liu; Carstens & Cahoon, LLP

(57) ABSTRACT

A boat protective extension platform apparatus for use in connection with watercraft lifting platforms is provided. The extension platform is preferably attached to the stern of a boat and serves to at least partially cover a gap created between the boat and the lifting platform when the lifting platform is in a lowered position. The extension platform can include a retractable screen that is removably attachable to the lifting platform such than when said screen is extended, the aforementioned gap is further covered, thus preventing items carried by passengers and crew from falling or rolling into said gap and being lost or damaged.

10 Claims, 8 Drawing Sheets

PROTECTIVE BOAT SWIM-STEP EXTENSION PLATFORM

BACKGROUND OF THE INVENTION

1. Technical Field of the Invention

The present invention relates generally to boats and in particular, to a protective extension platform and associated apparatus for use in connection with stern-mounted watercraft lifting platforms.

2. Description of the Related Art

The use of lifting platforms mounted to the stern or transom of boats has become more prevalent in recent years due to the increased popularity of smaller watercraft adapted for use with such platforms. Stern-mounted boat lifting platforms allow a watercraft, such as a jet-ski or dingy, to be safely secured to the stern of a boat without taking up valuable deck space. This configuration provides both more space for passengers and crew, and also aids in keeping sightlines from being obscured, an important advantage when navigating congested waterways. Stern-mounted lifting platforms are also conveniently positioned on boats to allow for easy access by passengers from the larger boat to the watercraft, and vice versa.

Boat lifting platforms are typically mounted to the aft (stern) of the boat, although they could conceivably be mounted at other points on a boat if it were desirable and such placement did not substantially interfere with the operation of the boat or endanger the safety of the boat passengers and crew. The lifting platform, along with the mechanism used to lift and lower said platform, is typically mounted to the hull of a boat near or slightly below the waterline as it exists under normal operating conditions. A control mechanism mounted near the lifting platform, or more typically near the wheel and other control features used to steer and operate the boat, allows a user to control the upward and downward movement of the lifting platform. Such control mechanism are typically located where the user operating such controls can easily observe the lifting platform.

When a boat is underway, the lifting platform is normally secured in a raised position to decrease water drag and any instability that might be created as a result of interaction between the water and a lowered platform. Once forward movement of the boat has stopped, the lifting platform and the watercraft mounted thereon may be lowered at least partially into the water to allow for passengers to board and to allow the watercraft to dismount from the boat. A user operating the lifting platform control mechanism may lower the lifting platform and watercraft (with passenger(s)) into the water, allowing the watercraft to begin floating, at which point the watercraft can be safely maneuvered away from the boat.

In order to prevent any inadvertent collisions between the boat and the watercraft, especially in rough sea conditions, the lifting platform is configured to move rearward with respect to the boat as said platform is lowered. As result of the platform moving in a rearward direction when lowered, a substantial void or "gap" is created between the boat and the watercraft. The gap created extends both horizontally and vertically from the rear edge (a peripheral edge) of the boat stern to the forward end of the platform. The resulting gap not only makes it more difficult to board the watercraft when the lifting platform is lowered, it is also creates a safety hazard for passengers and crew as they attempt to transit from the boat to the platform/watercraft and likewise, when such persons attempt to transit back from the platform/watercraft to the boat. In particular, the open gap increases the possibility that persons may misstep and fall into the gap, causing injury when coming into contact with arms of the lifting platform, the boat propeller, or simply due to exposure to water. This possibility of harm (including the possibility of drowning) varies with various different movement configurations of lifting platforms. The likelihood of injury caused by the gap is also increased as weather and sea conditions become more inclement. Further, the age and physical ability of passengers may also be factors in any injuries caused as a result of transiting from the boat to the lifting platform.

An example of an embodiment of a stern-mounted boat lifting platform found in the prior art is shown in FIG. 1 in order to provide the reader with a better understanding of the problems inherent in such prior art lifting platforms. The lifting platform (0105) is configured to include a watercraft cradle (0109) that allows a watercraft (0120) to be mounted safely and securely on the aft of the boat (0101). The watercraft cradle also helps to stabilize the watercraft during movement of the lifting platform. The lifting platform (0105) is mounted on its underside to the boat by a hydraulic lift system (not shown). The stern of the boat is formed with a portion that is cut out to create what is sometime referred to as a "swim platform" or alternatively a "swim-step" (0106). The swim-step provides persons with easy access to the water from rear of the boat (0101). The swim-step also allows for easier access to the boat from the water.

When used in conjunction with a lifting platform, a swim-step also provides an easy segue to the lifting platform (0105) while the lifting platform is in the raised position. When the lifting platform (0105) is in the raised position, the top surface of the lifting platform is typically flush with the top surface of the swim-step (0106). The mechanism used to raise and lower the lifting platform, in most cases a hydraulically or electrically powered mechanism, lowers the lifting platform (0105) into the water which in turn allows the watercraft (0120) to be safely deployed off the back off the boat. The mechanism both lowers the lifting platform and extends it away from the stern of the boat in order to prevent an inadvertent collision between the boat and the watercraft (0120). As previously mentioned, the gap that is created as a result of this configuration of the lifting platform is a substantial safety hazard due to the possibility that passengers and crew may come into contact with mechanical parts associated with the lifting platform, the boat's propeller(s), and the water. Moreover, the presence of the gap created between the lifting platform and the boat also creates the possibility that items carried by passengers or crew (beverage containers, fishing gear, cameras, binoculars, clothing items, etc.) may be lost or damaged were said items to fall into the gap. These problems inherent in the prior art are in dire need of a solution.

SUMMARY OF THE INVENTION

Accordingly, there is provided herein, in various embodiments, a protective boat extension platform that provides for more convenient and safer access to watercraft lifting platforms and to the actual watercraft mounted thereon. The present invention seeks to remedy many of the problems found in the prior art discussed above. In one aspect of the invention, an extension platform is attached to a swim-step or other surface adjacent to a lifting platform. The extension platform is configured to extend past the rear edge of the boat stern to fully or at least partially cover the gap that is created when a lifting platform is lowered. Furthermore, in other aspects of the invention, a first end of a retractable screen is mounted on the extension platform. The second end of said screen is attached to the lifting platform. The screen is configured such that the screen is retracted when the lifting platform is in the raised position but will deploy as said platform is lowered. In this manner, the screen not only will prevent items from rolling off the lifting platform into the gap that is created when the lifting platform is lowered, but will also serve as a safety device to prevent someone's foot, toe, or any other foreign object from being caught between the lifting platform and swim-step extension as the lifting platform is being raised.

BRIEF DESCRIPTION OF THE SEVERAL VIEWS OF THE DRAWINGS

A more complete understanding of the invention may be had by reference to the following detailed description when taken in conjunction with the accompanying drawings, wherein.

Figure 1:
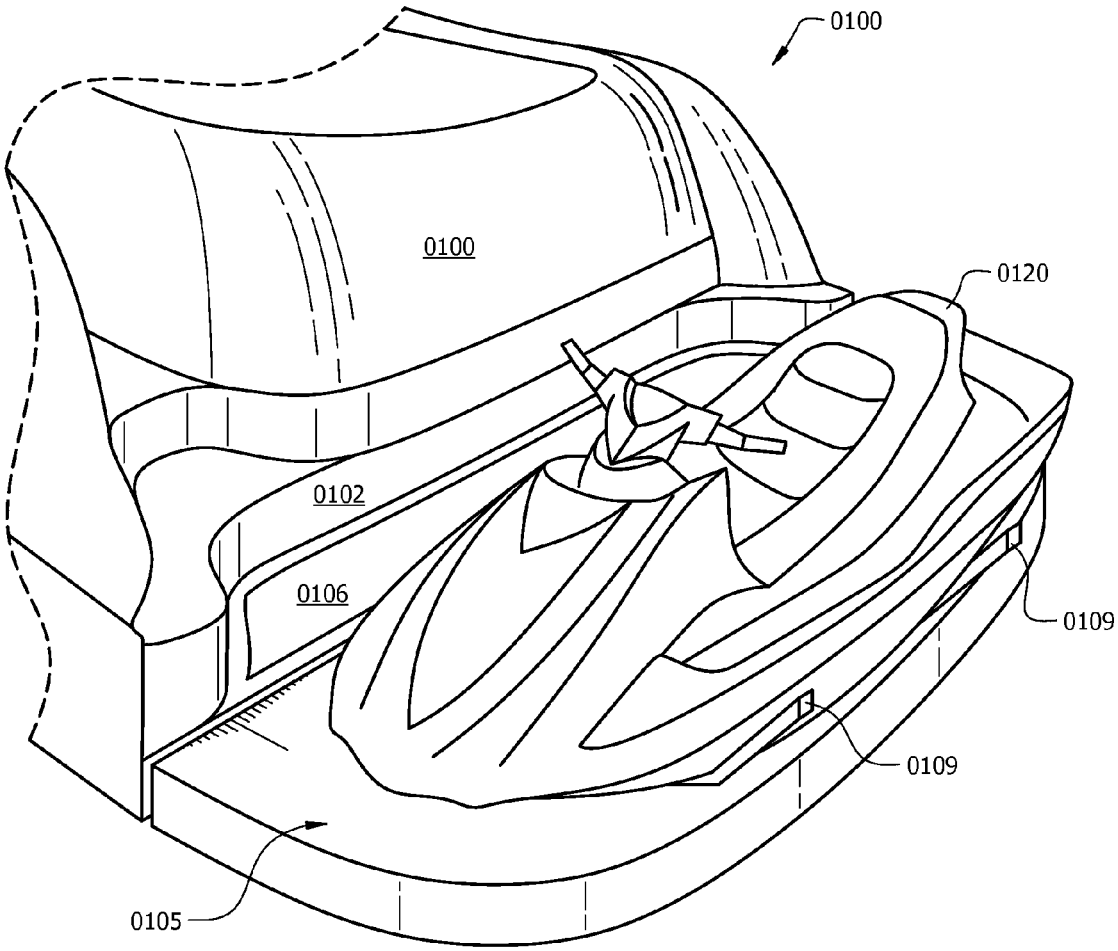
FIG. 1 (Prior Art)
FIG. 1 shows a perspective view of a prior art boat lifting platform as it appears when it is in the raised position.

Where used in the various figures of the drawings, the same reference numerals designate the same or similar parts. Furthermore, when the terms "front," "back," "rear," "aft," "forward," "first," "second," "upper," "lower," "height," "top," "bottom," "outer," "inner," "width," "length," "end," "side," "horizontal," "vertical," and similar terms are used herein, it should be understood that these terms have reference only to the structure shown in the drawing and are utilized only to facilitate describing the invention.

All figures are drawn for ease of explanation of the basic teachings of the present invention only; the extensions of the figures with respect to number, position, relationship, and dimensions of the parts to form the preferred embodiment will either be explained or will be within the skill of persons of ordinary skill in the art after the following teachings of the present invention have been read and understood. Further, the exact dimensions and dimensional proportions to conform to specific width, length, and similar requirements will likewise be within the skill of the art after the following teachings of the present invention have been read and understood.

DETAILED DESCRIPTION OF THE DRAWINGS

Several embodiments of Applicant's invention will now be described with reference to the drawings. In most cases, the items being discussed below correlate to a figure and a reference numeral appearing on the attached drawings.

Figure 2:
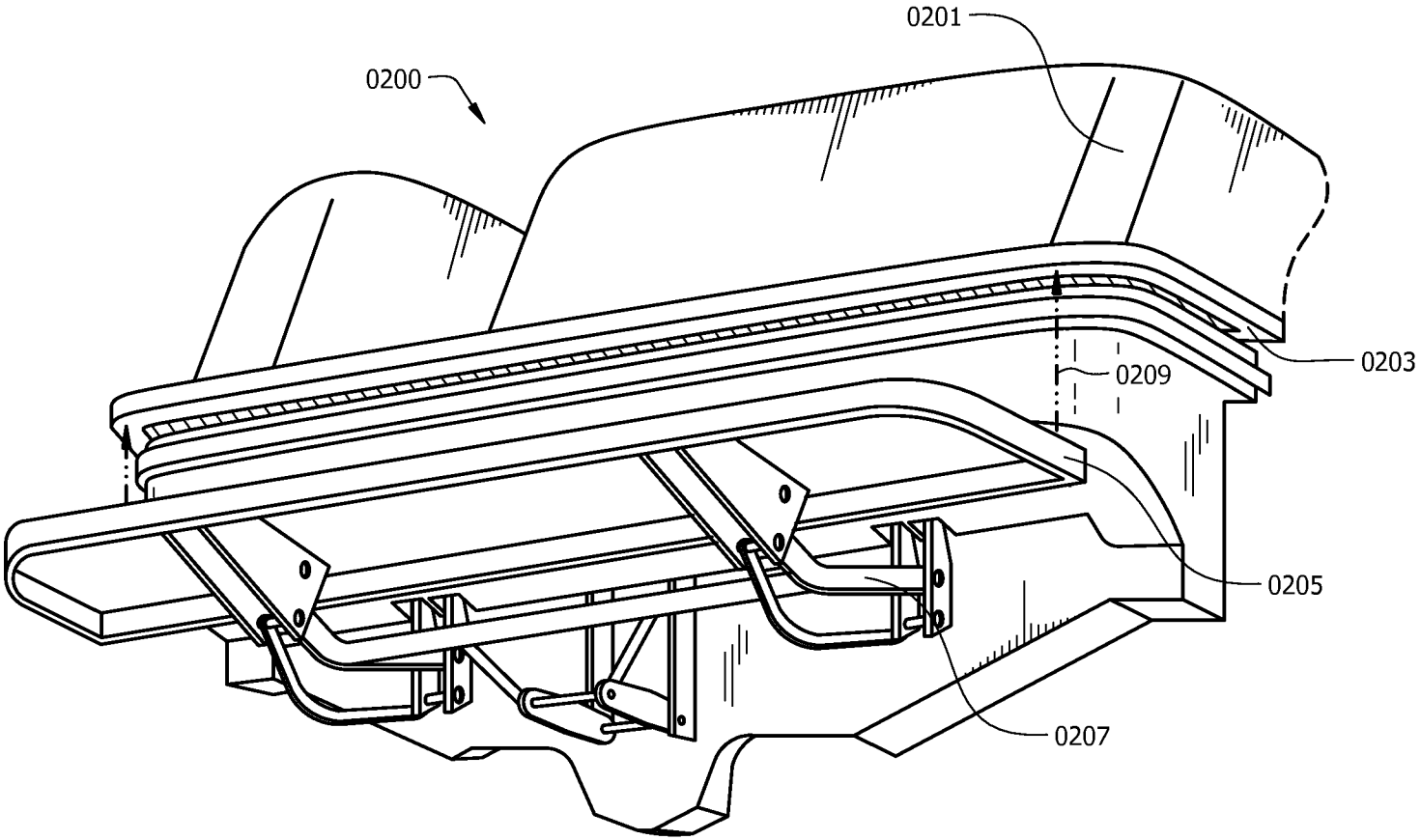
FIG. 2 shows an underneath perspective view of an embodiment of the extension platform of the present invention.

Referring now to FIG. 2 (0200), an underneath perspective view of an embodiment of the extension platform of the present invention (0205) shown adjacent to a lifting platform (0205) in the lowered position. This view shows a hydraulic lifting mechanism (0207) between the underside of the boat (0201) and the underside of the lifting platform (0205). The bottom surface of the extension platform (0203) is mounted to the top surface of a swim-step of a boat, which is located on the stern of the boat (0201). In the embodiment shown in FIG. 2, the extension platform extends beyond the aft edge of the boat (0201), creating an overhang portion of said platform that is visible from the perspective shown in said figure. The motion arrow (0209) depicts the movement of the lifting platform from the lowered position to the raised position. When transitioning from a lowered position to a raised position, the lifting platform moves forward (towards the bow of the boat) to the point that the upper surface of the lifting platform rests underneath a lower surface of the extension platform (0203). In the embodiment shown in FIG. 2, little to no gap exists laterally between the stern and the lifting platform when said platform is in the raised position.

As previously mentioned, the lifting platform is preferably mounted on the stern of a boat but may alternatively be mounted at other locations on a boat such as, for example, one of the sides of a boat. Likewise, the extension platform of the present invention, in alternate embodiments, could similarly be mounted at other locations on a boat and on surfaces other than the swim-step. In fact, in alternate embodiments, the extension platform could be mounted on the hull located on a side or front of a boat and still effectively serve its purpose. The extension platform, on whatever side of the boat it is mounted, should preferably be mounted on a surface of the boat that is adjacent to a peripheral edge of the boat. As used herein, the term "peripheral edge" refers to those surfaces of a boat that are adjacent to water when the boat is placed in water.

Figure 3:
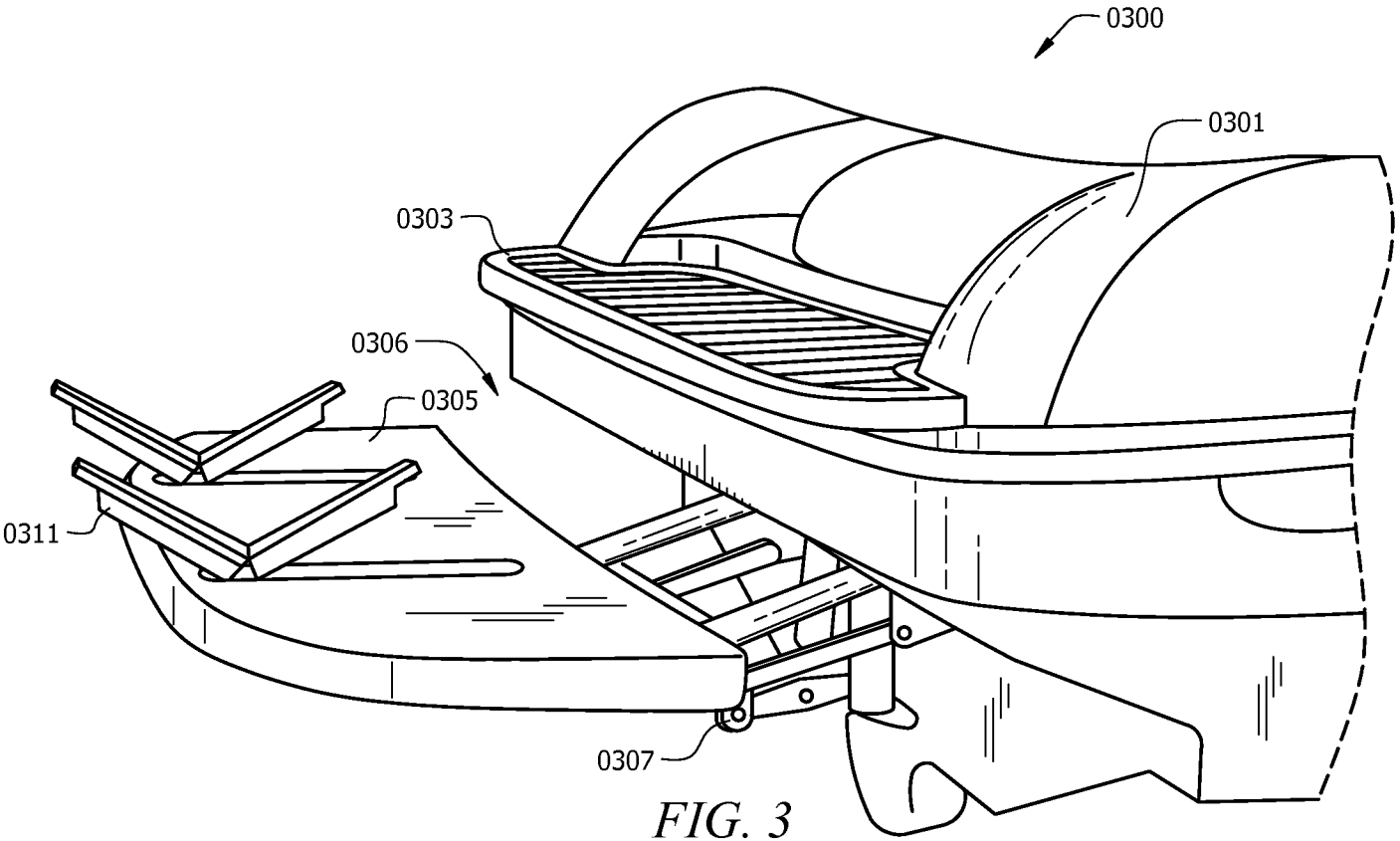
FIG. 3 shows an angled side view of the embodiment of the invention shown in FIG. 2.

Now referring to FIG. 3 (0300), an angled side view of the embodiment of the extension platform and adjacent lowered lifting platform shown in FIG. 2 (0200). In the embodiment shown, the extension platform is mounted on the top surface of the swim-step, completely covering said swim-step. However, it is contemplated that alternate embodiments of the extension platform may only cover a portion of the swim-step or some other surface of the boat. The rear portion of the extension platform (0303) extends beyond the rear edge (stern) of the boat (0301), thus at least partially bridging the lateral gap (0306) created between the boat and the lifting platform when said platform is lowered. A pair of watercraft cradles (0311) are mounted to the top of the lifting platform. The cradles secure and stabilize the watercraft mounted on the lifting platform while the platform is in the raised position and also when in the lowered position. When the lifting platform is lowered, the watercraft will eventually begin floating as the lifting platform submerges into the water. When not in use, the watercraft cradles may be lowered and are configured for resting within the lifting platform.

Figure 4:
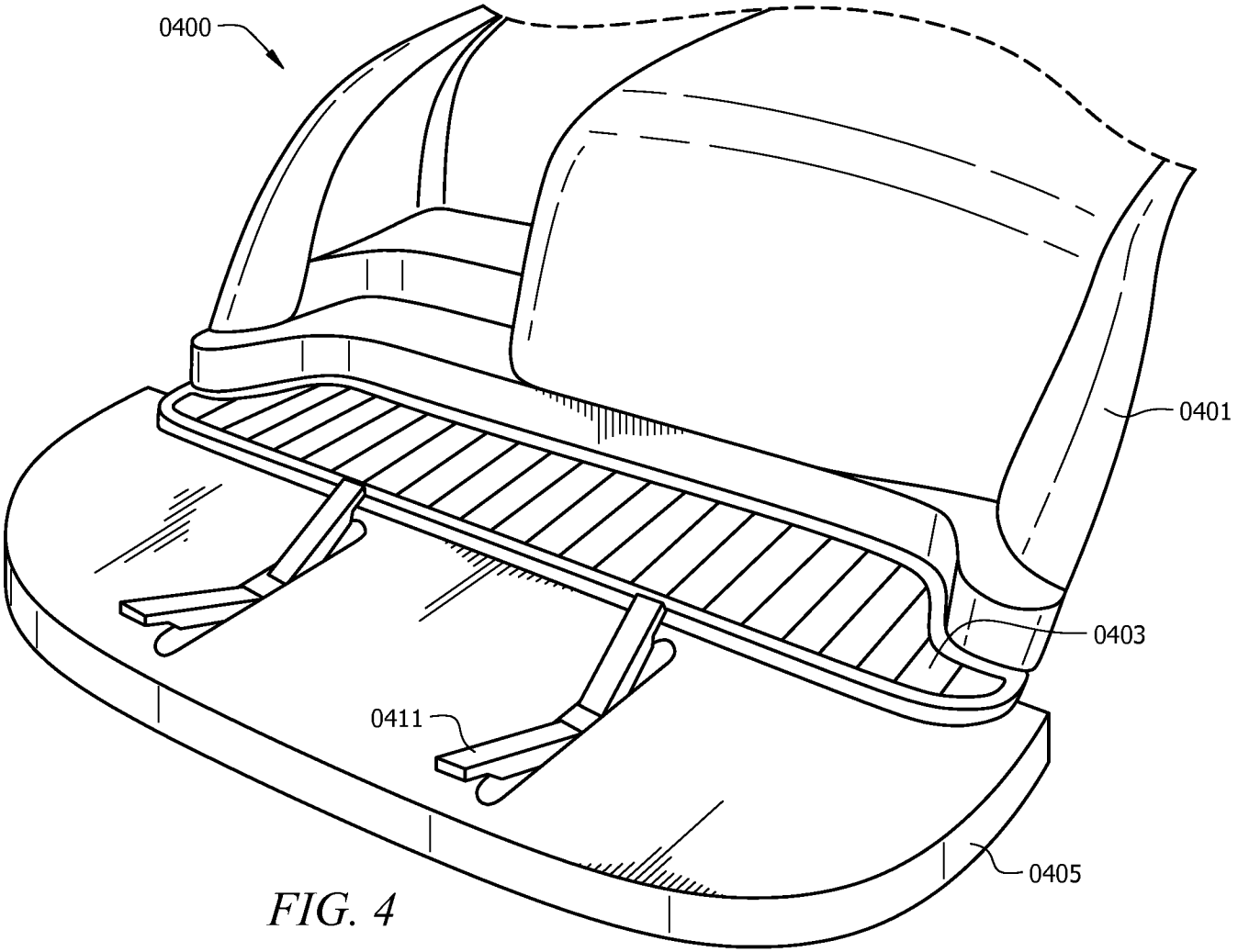
FIG. 4 shows an overhead perspective view of an embodiment of the platform extension of the present invention, said platform extension being adjacent to the lifting platform in the raised position.

Now referring to FIG. 4, an overhead perspective view of an embodiment of the platform extension (0403) of the present invention, the figure illustrates the position of the extension platform as it is positioned in relation to the stern of the boat (0401) while the lifting platform (0405) in the raised position. The extension platform (0403) is secured to the top surface of the swim-step of the stern of the boat (0401). When raised, the most forward portion (portion towards the bow of the boat) of the lifting platform rests underneath the most aft portion of the extension platform.

Figure 5:
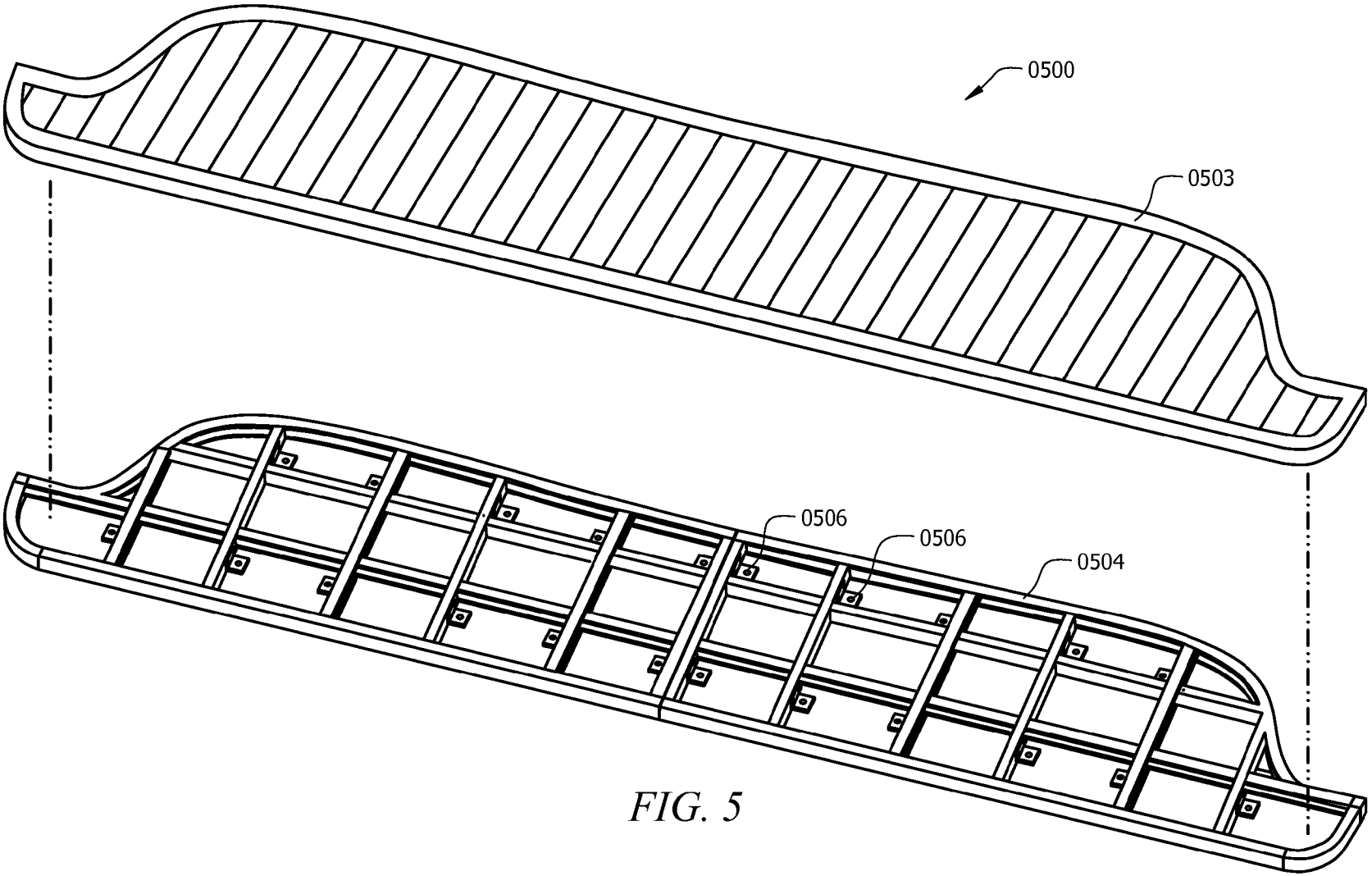
FIG. 5 shows an exploded view of an embodiment of the frame and decking of the extension platform of the present invention.

Referring now to FIG. 5, an exploded view of an embodiment of the frame and decking of the extension platform of the present invention, said extension platform is composed of an upper decking (0503) and a frame (0504). The decking (0503) which comprises a top portion of the extension platform, and frame (0504) which comprises a bottom portion of the extension platform, are shaped in order to correspond to the shape of the stern of the boat and in the preferred embodiment shown in FIG. 5, to the boat's swim-step (not shown) surface. It should be noted that while the shape of the extension platform shown in FIG. 5 corresponds to the configuration of the swim-step of some boats, it is contemplated that alternate embodiments of the extension platform may be formed in any number of shapes. In fact, the shape of the extension platform can be readily modified to fit the size and shape of any particular boat. It is also not essential to the invention that the extension platform be composed of both a separate decking and a frame. Alternate embodiments of the extension platform could be constructed of a single combined frame and integral decking.

Likewise, the extension platform could be constructed of a plurality of separate smaller modules that are easily stored when not in use (for example, when the boat is in port or when the lifting platform will not be used) but that are configured to be joined or fastened together by hand or with the aid of tools when the platform is to be used. For example, the extension platform modules could be formed to include tabs and joints for interlocking said modules together by hand. Similarly, the extension platform modules could include flanges that are configured to be fastened together with screws, magnets, Velcro type attachments, and other connectors or fasteners known in the art. In other alternate embodiments, the extension platform may be constructed of modules that are connected together by hinges such that the platform may be folded (by means of the hinges) and easily stored on the boat or elsewhere when not in use.

In the embodiment of the extension platform shown in FIG. 5, the frame includes flanges (0506) that allow for insertion of a bolt or screw. The flanges can be used to both, secure the extension platform to the boat and to secure the deck to the frame. However, it is also contemplated that in alternate embodiment, any other means for attaching the frame to the decking, or the extension platform to the swim-step, can be used. For example, the extension platform may be mounted to the boat by other means such as adhesives, by welding, etc. The decking (0503) is preferably constructed of teakwood but any decking materials known in the art can be used such as plastics, woods other than teak, metals, metalloids, carbon, etc. Similarly, a preferred exemplary embodiment of the frame comprises aluminum; however any framing materials known in the art can be used such as metals, metalloids, woods, plastics, carbon, steels etc. The extension platform may also be constructed of buoyant materials such that said platform can float if it falls into water.

Other alternate embodiments of the extension platform may be at least partially constructed of soft materials such as foam, soft plastics, etc. The use of such soft materials to construct the platform, especially along the edges of the platform, can aid in reducing the chance of injury should a person contact the surface of the platform with excessive force. Such soft materials utilized in connection with the platform may also reduce any chance that a watercraft is damaged should the boat and watercraft collide.

Figure 6:
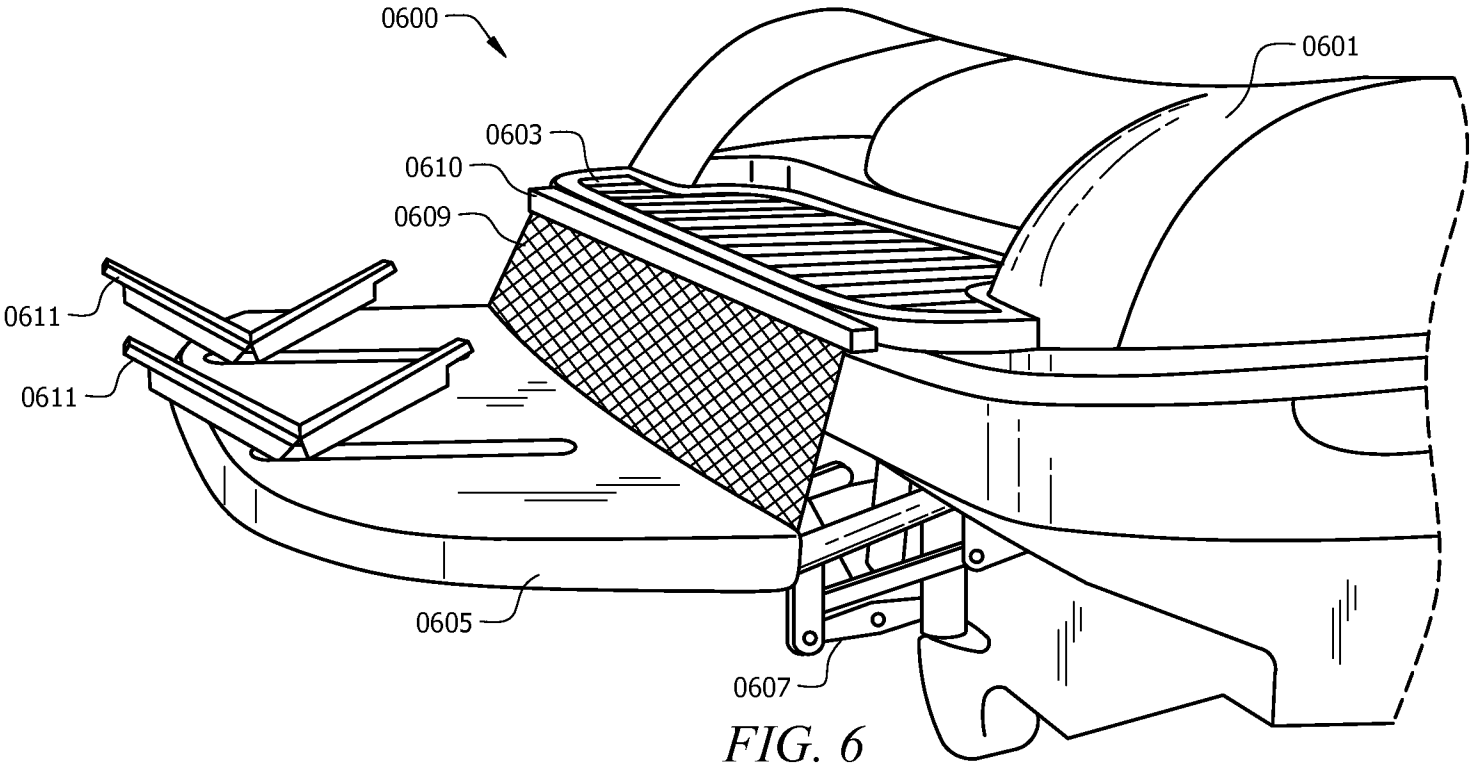
FIG. 6 shows an angled side view of an alternate embodiment of the present invention, having retractable screen mounted to an end of the extension platform.

Referring now to FIG. 6, an angled side view of an alternate embodiment of the present invention, having a first end of a retractable screen (0609) mounted to a rear end of the extension platform, is shown. One end of the screen (0609) is attached to a screen housing (0610) that is mounted to the extension platform. A second end of the screen is removably attached to the lifting platform (0605). The screen housing includes a spring mechanism (not shown) to retract said screen when the lifting platform (0605) is in the raised position or when not attached to the lifting platform. Although not essential to the invention, the housing serves to protect the screen from damage that could occur when not in use.

The retractable screen of the alternate embodiment of the platform extension invention shown in FIG. 6 further aids in solving some of the problems in the prior art discussed above. More specifically, the screen, when extended, serves to prevent items that may be carried by passengers/crew to or from the lifting platform, from falling into the gap. Passengers of the types of watercraft typically used in connection with lifting platforms often carry various small items with them for use on said watercraft. For example, passengers embarking on a jet-ski may carry sunscreen, sunglasses, cameras, fishing gear, beverage containers, hats, snorkel/scuba gear, etc. Even in relatively calm sea conditions, it is easy for passengers to lose their grasp of such items or for them to fall from containers. In the absence of the screen, these items may fall or roll into the gap between the lifting platform and the boat as previously discussed. After falling into the gap, it is often difficult to retrieve such items. The retractable screen of the alternate embodiment of the extension platform shown in FIG. 6 prevents such items from falling or rolling into the gap.

In alternate embodiments, screens having other configurations may be used to perform the same function of providing a physical barrier between the lifting platform and the gap. For example, an accordion type screen may be used such that the screen folds up in a "zig-zag" fashion to rest on the lifting platform when the lifting platform is in the raised position, or folds into a recessed portion of the lifting platform, extension platform, or other boat structure. The screen would then unfold as the lifting platform was lowered or if manually released by a user. In such an alternate folded accordion embodiment of the screen, no housing would be necessary. Also, it should be noted that while the screen of the alternate embodiment is constructed of a fiber mesh to provide a lightweight material which is permeable to water, alternate embodiments of the screen may be constructed of other materials that are more or less durable in nature. For example, alternate embodiments of the screen could be more durably constructed of canvas, plastic, or metal such that said screen can also serve as a structure to assist passengers in stepping down onto the lowered lifting platform. In other alternate embodiments, steps may be formed into the screen or as a further attachment to the screen, to further aid in passengers using the screen to transit between the boat and the lifting platform.

Figure 7A:
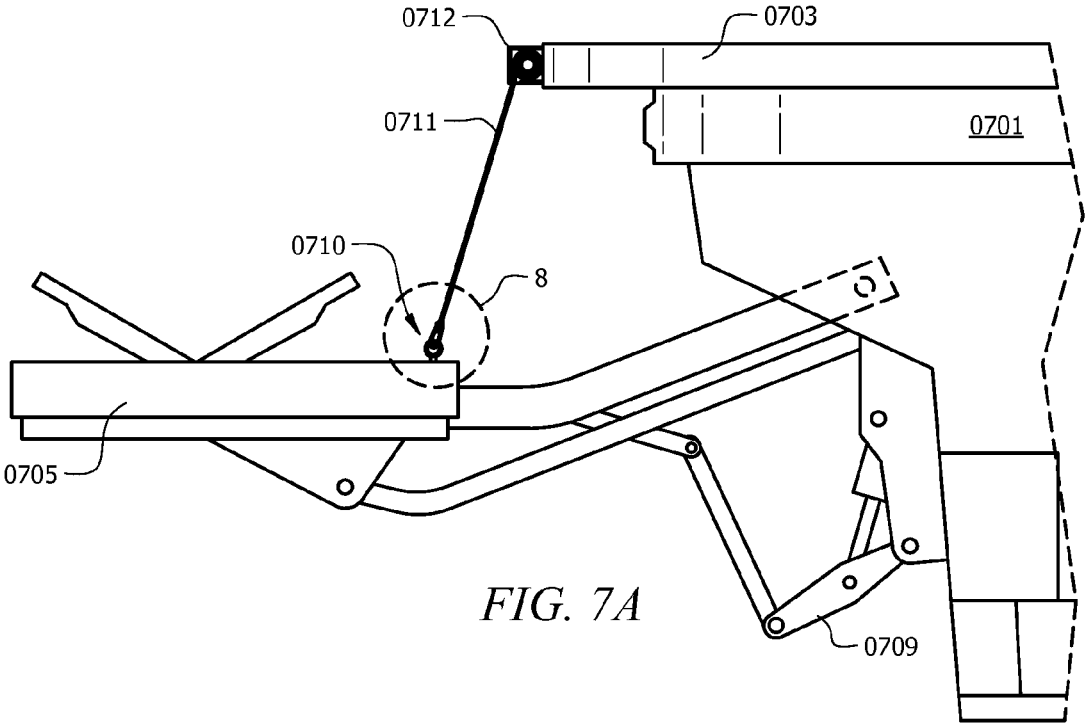
FIGS. 7A and 7B shows a side view of the lifting platform (in the lowered position and raised position, respectively) and extension platform with mounted retractable screen as shown in FIG. 6, an end of said screen being attached to said lifting platform.
Figure 7B:
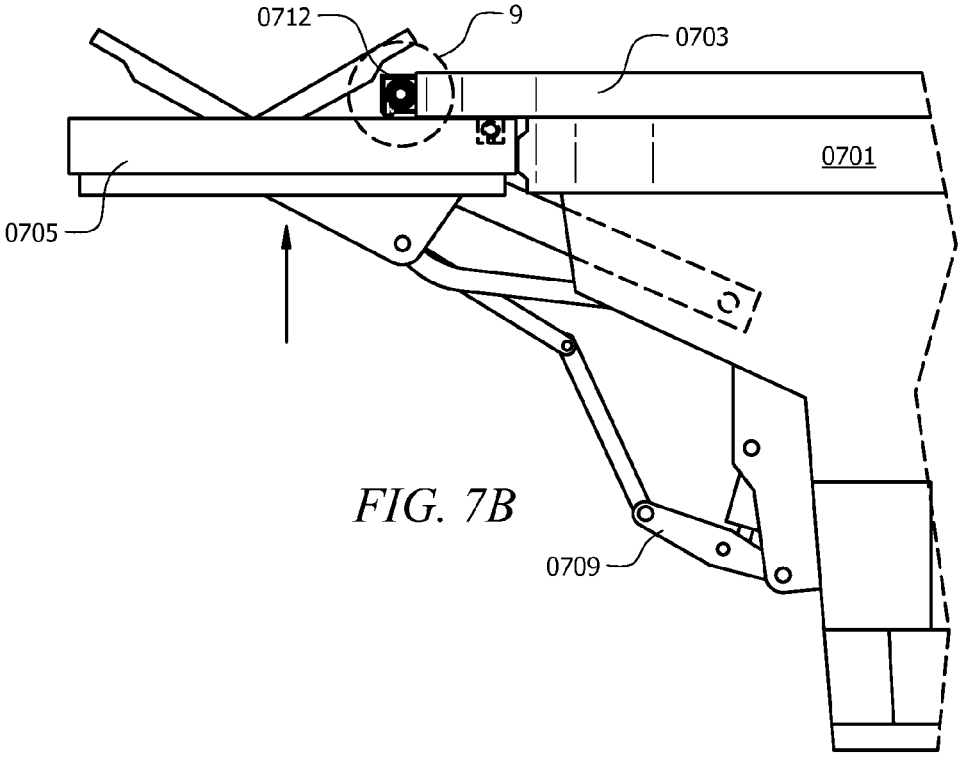

Referring now to FIGS. 7A and 7B, side views are shown of the lifting platform (in the lowered position and raised position, respectively) and the alternate embodiment of the extension platform (0703) with mounted retractable screen (0711) as shown in FIG. 6, an end of said screen (0710) being attached to said lifting platform (0705). The screen housing (0712) serves as an enclosure to protect the screen and to store said screen when not in use. While the alternate embodiment of the invention shown in FIGS. 6, 7A, and 7B show the screen housing mounted to the aft end of the extension platform, further alternate embodiments of the invention may include a screen housing mounted to some other portion of the extension platform or boat, or may alternatively be mounted to the lifting platform. In fact, in other alternate embodiments of the invention, the screen housing may be mounted within a recessed portion of either the extension platform or the lifting platform so as to not be exposed to foot traffic. The mounting points at which the screen is attached to the lifting platform (or alternatively to the extension platform) may be readily changed to suit the particular needs of the users.

In further other alternate embodiments of the invention (not shown), the extension platform may be configured to automatically slide forward and rearward with respect to the boat, depending on the position of the lifting platform. In such alternate embodiments, the extension platform may have one or more rails or guides mounted to the underside and/or sides of said extension platform that are adapted for sliding the platform forward (towards bow) and rearward (towards stern) with respect to the boat. Such extendable boat deck surfaces utilizing rails and/or guides are generally known in the art, such as, for example, the embodiments shown and discussed in U.S. Pat. No. 6,298,801 ("Extendable Deck Assembly For A Boat"), the teachings of which are incorporated by reference herein.

In alternate embodiments of the present invention, the extension platform and attached rails or guides may be mounted to a correspondingly configured swim-step or other structure of the boat to allow for controlled movement of the extension platform. The movement of the extension platform may be mechanically powered by, for example, an electric motor. Alternatively the movement of the extension platform may be configured to allow users to manually move said platform forwards and rearwards. If used in connection with an electric motor, the alternate embodiment extension platform may be configured to automatically extend rearward (towards the aft direction) in conjunction with, and simultaneous with, the lowering of the lifting platform. Conversely, the extension platform may be configured to automatically and simultaneously retract forward (towards the bow) when the lifting platform is raised. The same control mechanism used to control the lifting platform may be used to also electronically control the deployment and retraction of the extension platform.

Figure 8:
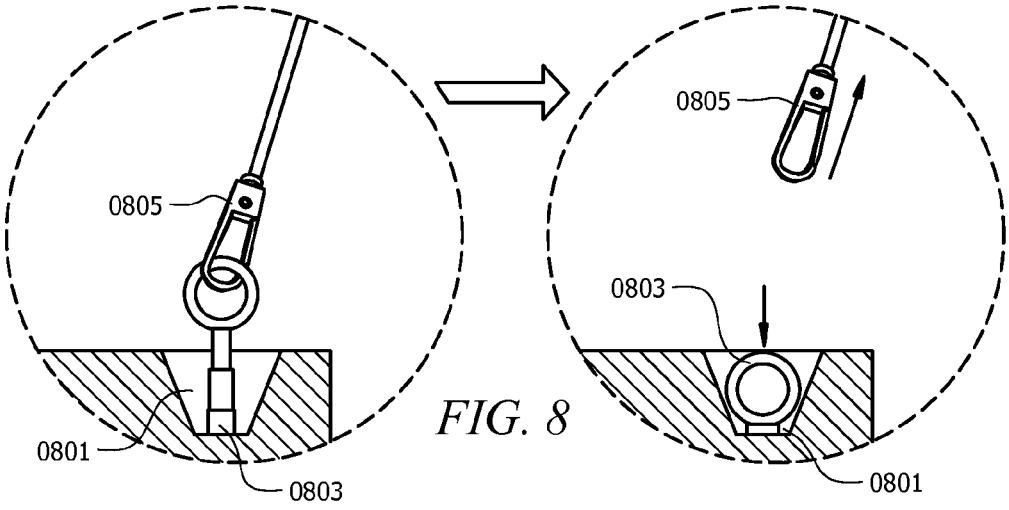
FIG. 8 shows an embodiment of a mechanism for attaching an end of the retractable screen of the alternate embodiment of the invention shown in FIG. 6, to a lifting platform, said FIG. depicting the screen attached to the lifting platform and in a state of retraction.
Figure 9:
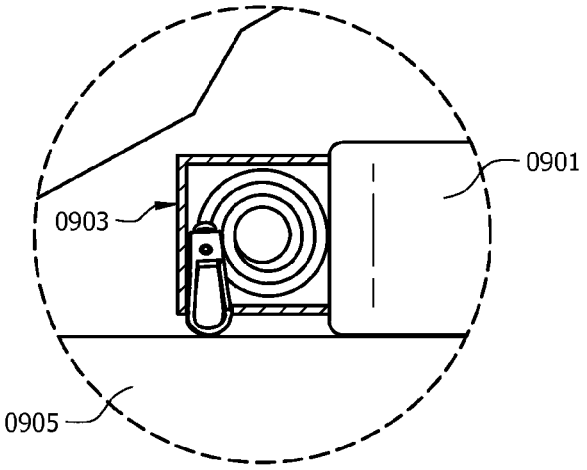
FIG. 9 shows a cutaway view of the screen of the alternate embodiment shown in FIG. 6 as it appears retracted within the housing enclosing said screen.

Referring now to FIG. 8, side views are shown of an embodiment of a mechanism for attaching an end of the retractable screen of the alternate embodiment of the invention shown in FIG. 6, to a lifting platform. FIG. 8 depicts both the screen attached to the lifting platform and also said screen in a state of disconnection from the lifting platform and retraction. In the preferred embodiment, a retractable hoop (0803) that recedes into a cavity is utilized because it is configured to ensure the hoop is completely below the surface of the lifting platform when said hoop (0803) is not attached to the screen. The screen is attached to the hoop by means of a spring-loaded clip (0805) similar in function to a carabiner. A further near view of the screen housing (0903) is shown in FIG. 9 (0900). The screen housing includes an opening just large enough to allow the majority of the clip (0907) to recede into said housing. The housing (0903) can be attached to the end of the extension platform (0901) (or whatever structure used as discussed above) by any means known in the art including but not limited to a fastener, an adhesive, weld, etc.

Figure 10:
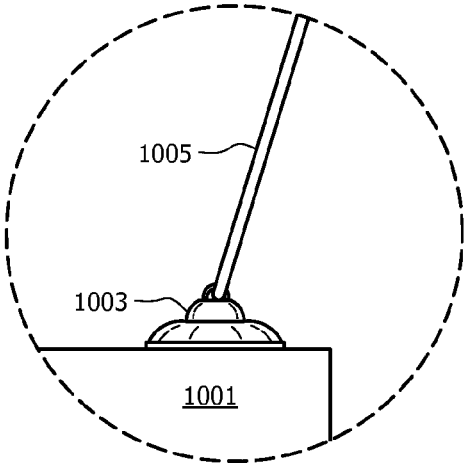
FIG. 10 shows a further alternate embodiment of a means for attaching an end of a retractable screen to the lifting platform.

Referring now to FIG. 10, a further alternate embodiment of a means for attaching an end of a retractable screen to the lifting platform is shown in side view. The screen (1005) is secured to the lifting platform (1001) by a suction cup (1003). The screen is pulled out of the screen housing and is secured to the top surface of the lifting platform (1001) by a suction cup, which allows for easy attachment and removal of the screen. Any means known in the art for attaching a screen can be employed to secure the screen to the deck of the lifting platform.

It should be noted that the description of the present invention has been presented for purposes of illustration and description, and is not intended to be exhaustive or limited to the invention in the form disclosed. Many modifications and variations will be apparent to those of ordinary skill in the art. The preferred embodiment appearing in the drawings was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims.

I claim:

1. A protective boat extension platform comprising:

an extension platform having a forward end and a rear end, said extension platform having a bottom surface adapted for mounting onto a boat surface, said boat surface being positioned adjacent to both a peripheral edge of said boat and a mechanically actuated lifting platform;

wherein said lifting platform is mounted to said boat and is configured to mechanically lower with respect to said boat, creating a lateral gap between said boat and said lifting platform; and wherein said rear end of said extension platform extends laterally beyond said peripheral edge towards a front end of said lifting platform, to fully bridge the lateral gap between the peripheral edge of said boat and said lifting platform, and wherein an upper surface of said lifting platform rests underneath a lower surface of the extension platform when said lifting platform is in a raised position.

2. The extension platform of claim 1 wherein said extension platform is mounted to a swimstep surface formed into a rear portion of said boat.

3. The extension platform of claim 1 wherein said extension platform further comprises a top portion constructed of teakwood.

4. The extension platform of claim 2 wherein a shape of said extension platform corresponds to said swim-step surface.

5. The extension platform of claim 3 wherein a deck of said extension platform is constructed of metal.

6. The extension platform of claim 3 wherein a soft material is formed around corners formed on said extension platform.

7. The extension platform of claim 3 wherein said extension platform further comprises a bottom portion constructed of an aluminum frame, said frame having a bottom surface being adapted for mounting to said boat surface and a top surface on which a deck is mounted.

8. The extension platform of claim 1, further comprising a retractable screen having a first end mounted within a screen housing having a mechanism for retracting said screen, said screen housing being mounted to said rear end of said extension platform, wherein a second end of said screen is removably attachable to said lifting platform.

9. The extension platform of claim 1, further comprising a retractable screen having a first end mounted within a screen housing having a mechanism for retracting said screen, said screen housing being mounted to said lifting platform, wherein a second end of said screen is removably attachable to said extension platform.

10. The extension platform of claim 8 wherein one or more fasteners are attached to said second end of said screen, said one or more fasteners adapted for securing said screen to said lifting platform.

* * * * *